US005765235A

United States Patent [19]

Arnold

[11] Patent Number: 5,765,235

[45] Date of Patent: Jun. 16, 1998

[54] ANTI-CONDENSATION VISOR

[75] Inventor: Derek Leslie Arnold, Emmeloord, Netherlands

[73] Assignee: Derek's Patent B.V., Emmeloord, Netherlands

[21] Appl. No.: 849,056

[22] PCT Filed: Nov. 20, 1995

[86] PCT No.: PCT/NL95/00394

§ 371 Date: May 29, 1997

§ 102(e) Date: May 29, 1997

[87] PCT Pub. No.: WO96/16563

PCT Pub. Date: Jun. 6, 1996

[30] Foreign Application Priority Data

Nov. 30, 1994 [NL] Netherlands ..... 9402012

[51] Int. Cl.[6] ..... A42B 3/24

[52] U.S. Cl. ..... 2/424; 2/15; 2/435

[58] Field of Search ..... 2/410, 6.4, 424, 2/425, 15, 10, 435, 441, 443, 9

[56] References Cited

U.S. PATENT DOCUMENTS

| | | | |
|---|---|---|---|
| 4,047,249 | 9/1977 | Booth . | |
| 4,101,980 | 7/1978 | Stepan et al. | 2/424 |
| 4,138,746 | 2/1979 | Bergmann . | |
| 4,584,721 | 4/1986 | Yamamoto | 2/435 |
| 5,500,953 | 3/1996 | Reuber et al. | 2/424 |
| 5,671,483 | 9/1997 | Reuber | 2/424 |

FOREIGN PATENT DOCUMENTS

| | | | |
|---|---|---|---|
| 2 526 642 | 11/1983 | France . | |
| 2675348 | 10/1992 | France | 2/424 |
| 32 29 021 | 2/1984 | Germany . | |
| 32 37 316 | 4/1984 | Germany . | |
| 33 23 419 | 1/1985 | Germany . | |
| 2 052 244 | 1/1981 | United Kingdom . | |

*Primary Examiner*—Michael A. Neas
*Attorney, Agent, or Firm*—Young & Thompson

[57] ABSTRACT

An anti-condensation visor comprises an outer visor which, relative to the user, is situated on the outermost peripheral surface of a helmet or hood to which the visor belongs. The outer visor is provided with openings for fitting on the helmet and with at least one lip for the user to fold the outer visor away. An inner visor is detachably fitted against the inside wall of the outer visor and is held against via at least one mechanical retaining element, while the inner visor rests over essentially its entire surface against the inside wall of the outer visor, and the inner visor is made of hydrophilic material.

13 Claims, 2 Drawing Sheets

ANTI-CONDENSATION VISOR

DESCRIPTION

1. Field of the Invention

The invention relates to an anti-condensation visor, comprising an outer visor which, relative to the user, is situated on the outermost peripheral surface of the helmet or hood to which said visor belongs, which is provided with openings for fitting of said outer visor on said helmet, and which is provided with at least one lip for the user to fold away said outer visor.

2. Background of the Invention

Anti-condensation visors are generally known. There are many applications known where a visor of a protective helmet or hood is provided with an anti-condensation facility. These known devices can be divided into two types. The first type is the anti-condensation visor in which a hydrophilic, anti-condensation layer is fitted on the inside wall of the outer visor. This layer can be fitted in various known ways in the form of a sheet or otherwise as a covering. The second type is the anti-condensation visor in which a double-glazed device is provided, comparable to the double-glazed devices which are known for windows of buildings and houses. In the case of this type there is a layer of air between the inner and the outer visor. In addition, condensation can be prevented by providing sufficient ventilation along the surface of the visor or by heating the surface of the visor by means of warm air or a heater, for example an electric heater.

Anti-condensation visors of the first type are common, but this type does have a number of major disadvantages. First, the hydrophilic layer is not fitted detachably, and the same layer cannot be fitted or removed many times in succession. It is therefore not possible to provide a visor with, for example, sun shade which can be fitted as desired. Secondly, the fitted layer weathers as time passes. As a result of the weathering, the layer can become detached and/or fall off in places, with the result that the anti-condensation effect is lost. Thirdly, the fitted layer has little or no scratch resistance. Scratches on a visor lead to undesirable dazzle, which is detrimental to (travelling) safety. Fourthly, the fitted layer is generally of low thickness, which adversely affects the anti-condensation effect compared with a thicker layer, which has a greater capacity for absorbing condensation. Fifthly, the hydrophilic layer must be fitted with great precision, for the layer has to be fitted tightly joined up, and there must be no inclusion of air.

Anti-condensation visors of the second type are also quite common. The greatest disadvantage of this type is that it requires a specific design for fitting. The thickness of such an anti-condensation visor in practice is a number of millimeters greater than the thickness of just an outer visor made from a single plastic layer. In any case, as regards motorcycle helmets, such an anti-condensation visor is not suitable for fitting on motorcycle helmets which have already been delivered, since they are designed for a much thinner visor. Besides, when such a type of anti-condensation visor is used the visor initially provided is superfluous, which incurs unnecessary waste and costs.

The prevention of condensation by means of ventilation with possibly warm air is found to work unsatisfactorily in practice in the case of motorcycling. In particular, when a motorcycle stops at, for example traffic lights, the ventilation for such prevention is inadequate.

The prevention of condensation by means of a heater is unsuitable for motorcycling in practice, due to the fact that such a heater requires, inter alia, a power supply and connecting wires, which means that it undesirably takes up space and is awkward as regards use. Besides, the heating wires obstruct the clear view of the user when these wires are situated in the visor.

U.S. Pat. No. 4,047,249 discloses a helmet having an outer visor and an inner visor. The inner visor comprises a sheet of polarizing material which is fixed to the outer visor by snapping means.

U.S. Pat. No. 4,138,746 describes a visor assembly comprising a number of adjacent visors which can be torn off after each other.

SUMMARY OF THE INVENTION

The object of the invention is to provide an anti-condensation visor which can be fitted on the vast majority or existing types of motorcycle helmets without radical design changes having to be made for that purpose, which visor can be fitted durably, and which is simple to change for another one, for example a new one or a dark one which serves as a sun shade, while such changing can be carried out without the ordinary visor having to be removed first, and which visor can be marketed as a separate set.

This object is achieved through the fact that an inner visor is detachably fitted against the inside wall of the outer visor and is held against said inside wall by means of at least one mechanical retaining means, while said inner visor rests over essentially its entire surface against the inside wall of the outer visor, and said inner visor is made of hydrophilic material.

Due to the fact that the inner visor is made of hydrophilic material, the inner visor absorbs the condensation arising. In order to prevent further condensation from forming on the inside surface of the outer visor, the inner visor must rest against said surface in such a way that no space is left between them. The detachability of the inner visor is obtained by providing a mechanical retaining means rather than a chemical retaining means such as, for example, a glue or a hot-melt, so that the inner visor can be removed or fitted by a specific action. Producing the mechanical retaining means in a specific way means that an initial tension can be produced in the inner visor, with the result that said inner visor is pressed against the inside wall of the outer visor. This promotes the desired resting of the inner visor against the inside surface of the outer visor, in order to prevent further condensation. In addition, the mechanical retaining means grips the inner visor in order to obtain a set comprising an inner and an outer visor.

The mechanical retaining means can be of any known type, provided that it is suitable for the envisaged purpose. The retaining means can be, for example, a pin-shaped element, around which a plastic bush is fitted. The plastic bush serves, on the one hand, to achieve some play between the inner visor and the retaining means and, on the other, to produce a clamping force on the inner visor. The pin-shaped element can be, for example, a blind rivet.

In the preferred embodiment the mechanical retaining means comprises two blind rivets which are fitted respectively through two openings to be made in the outer visor.

In order to obtain an initial tension for the purpose of pressing the inner visor against the inside wall of the outer visor, the inner visor has a radius of curvature which is greater than the radius of curvature of the outer visor. When the outer visor is fitted, and in that case is being gripped by the mechanical retaining means, the inner visor is pressed by at least the initial tension against the inside surface of the outer visor.

The mechanical retaining means can grip the inner visor through the fact that said inner visor is provided with at least one recess. In the preferred embodiment the inner visor has two recesses, one on two opposite edges of the inner visor.

In order to ensure that the inner visor is gripped in a suitable way by the mechanical retaining means, in the preferred embodiment the two blind rivets in the outer visor are placed at a distance from each other which is no greater than the distance between the recesses provided in the inner visor.

In order to permit easy manual fitting and removal of the inner visor, at least one lip is provided on the inner visor. A lip is preferably provided on two opposite sides of the inner visor, in order to permit easy manual fitting and removal of the inner visor for both left-handed and right-handed people.

On account of the possible spherical shape and the desired deformation of the inner visor for creating initial tension, it is advantageous for the inner visor to be made of a plastic. On account of the necessary hydrophilic nature of the inner visor, cellulose acetate, for example, can then be selected as the plastic.

In order to acquire a degree of protection from the sun, a colouring agent can be applied to essentially at least one of the surfaces of the inner visor. This can be achieved by means of, for example, a film or otherwise a coating. It is also possible for a colouring agent to be placed in the material from which the inner visor is made.

The inner visor can be marketed separately. This visor comprises at least one recess and at least one lip for handling the visor.

The anti-condensation visor will generally be marketed as a set. The set then comprises an inner visor and at least one retaining means. The set can be extended by at least one plastic bush.

BRIEF DESCRIPTION OF THE DRAWINGS

The invention will be illustrated further below with reference to the appended drawings, in which an exemplary embodiment is shown.

DETAILED DESCRIPTION OF THE INVENTION

Figure 1:
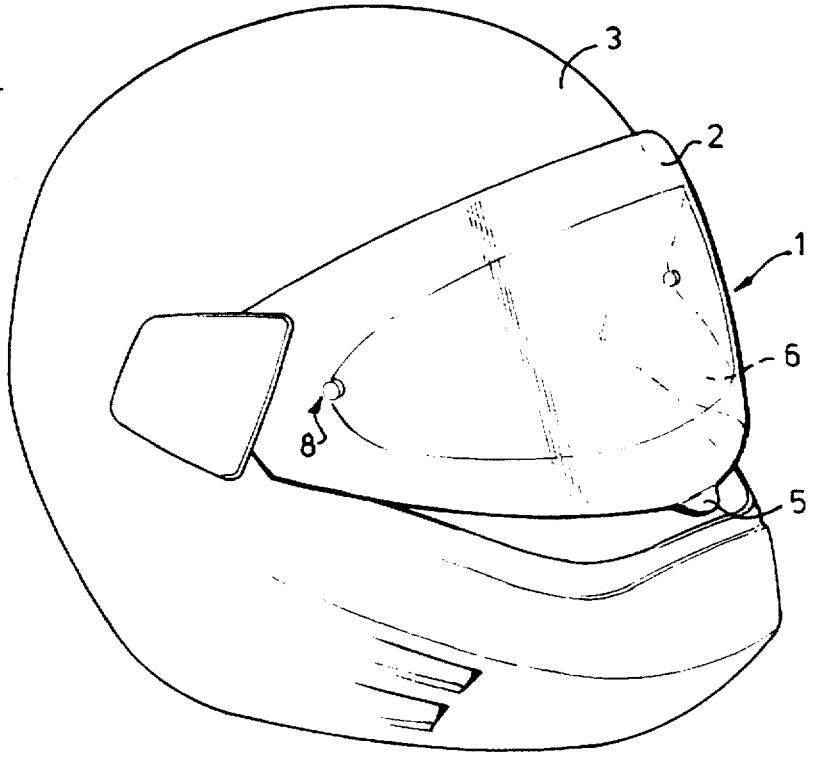
FIG. 1 shows a view of a helmet with anti-condensation visor in perspective.

FIG. 1 shows a motorcyclist's helmet 3 which is provided with an anti-condensation visor 1 according to the present invention. The anti-condensation visor comprises a generally known outer visor 2 and an inner visor 6 according to the invention. The outer visor 2 can be operated by the user by means of the generally known lip 5 fitted thereon. The inner visor 6 is fitted on the outer visor 2 by means of a retaining means 8 which projects partially through the outside surface of the outer visor.

Figure 2:
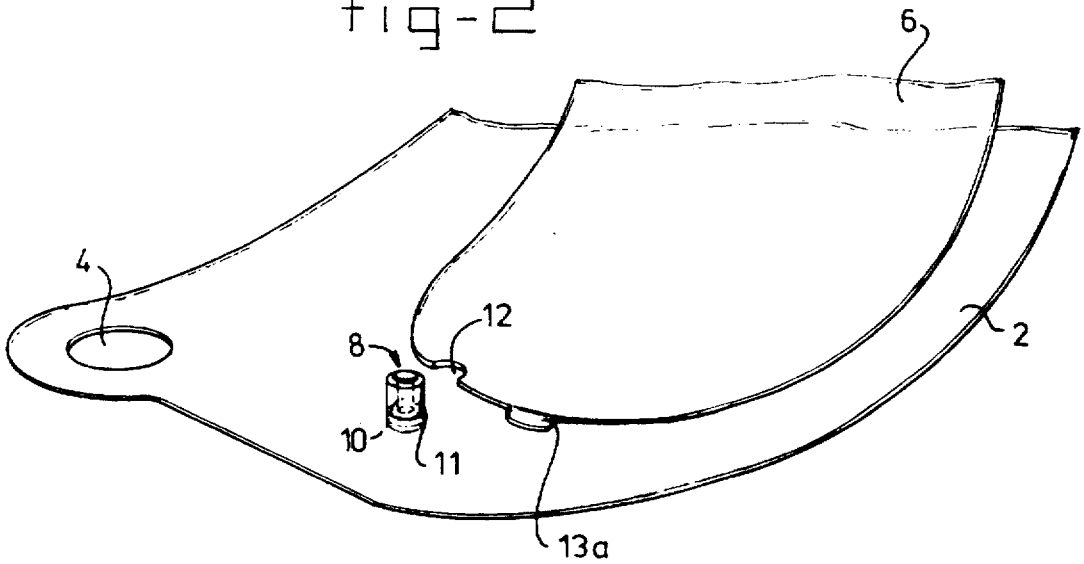
FIG. 2 shows a detail of the inner and outer visor in perspective.

As can be seen clearly from FIG. 2, the inner visor 6 can be fitted detachably against the inside wall of the outer visor by means of a mechanical retaining means 8. The retaining means 8 comprises a blind rivet 10, around which a plastic bush 11 is fitted. The blind rivet 10 is fitted on the outer visor through an opening in the outer visor. The mechanical retaining means 8 grips the inner visor 6 at the position of the recess 12. The inner visor 6 can be handled by the user by means of the lip **13*a* and/or lip 13*b* fitted thereon. The outer visor 2 is fixed rotatably on the helmet 3 in a generally known manner partly through the openings 4**.

Figure 3:
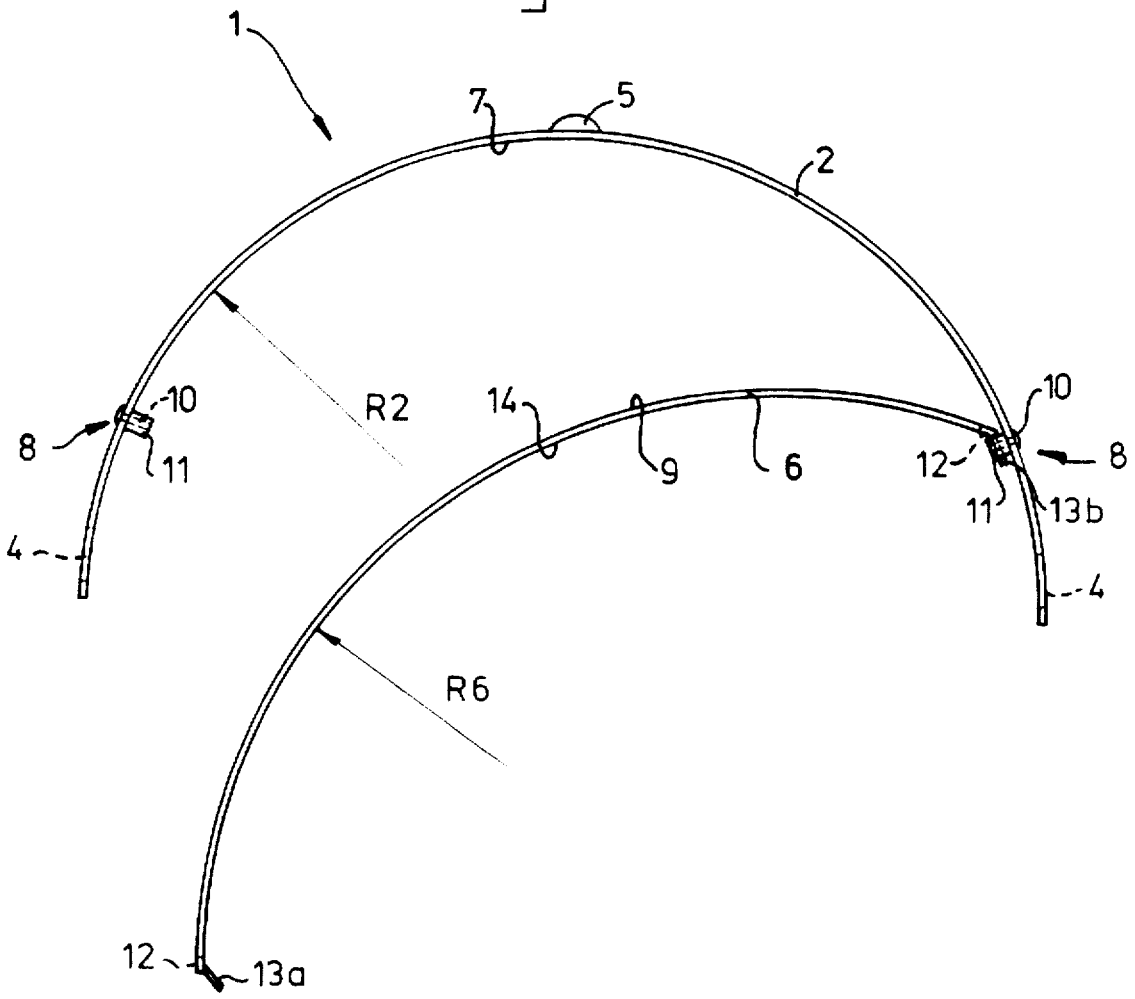
FIG. 3 shows a top view of the inner and outer visor prior to the fitting or after the removal of the inner visor.

As can be seen from FIG. 3, the inner visor 6 is fitted with its surface 9 against the inside wall 7 of the outer visor 2 between the retaining means 8. By taking hold of the lip **13*a* or 13*b*, the user can fit or remove the inner visor 6. The inner visor 6 is held against the outer visor 2 through the fact that, on the one hand, the inner visor fits between the retaining means 8 and, on the other hand, the radius of curvature R6 of the inner visor 6 is greater than the radius of curvature R2 of the outer visor 2. Due to the difference in radius of curvature, the inner visor 6 has the tendency to stretch between the retaining means 8 relative to the inside wall 7 of the outer visor 2. This stretching is prevented by the accurate positioning of the retaining means 8, which grip the inner visor 6 at the position of the recesses 12, so that the inner visor 6 is pressed with a certain initial tension against the outer visor 2**.

Although in FIG. 3 the outer visor 2 and the inner visor 6 are shown as visors which are flat in their vertical direction, i.e. the direction at right angles to the curvature with radii of curvature R2 and R6, they can also be made a spherical shape. This does not detract in any way from the present invention.

Although in the preamble to the present description and in the description of the figures the anti-condensation facility according to the invention is frequently and mainly described in relation to a motorcycle helmet visor, it is, of course, obvious to a person skilled in the art that the anti-condensation facility according to the invention can also be used for the visor of any other type of helmet or hood or for a screen or window through which a user wishes to look, for example a window of, for example, a vehicle (including vessels) or a building.

I claim:

1. Anti-condensation visor, comprising an outer visor which relative to use is situated on the outermost peripheral surface of a helmet to which said visor belongs, which visor is provided with openings for fitting of said outer visor on said helmet, and which is provided with a lip for a user to fold away said outer visor, wherein an inner visor is detachably fitted against the inside wall of the outer visor and is held against said inside wall by at least one mechanical retaining means, while said inner visor rests over essentially its entire surface against the inside wall of the outer visor, and said inner visor is made from hydrophilic material, and has a radius of curvature which is greater than the radius of curvature of the outer visor, in order to obtain an initial tension for the purpose of pressing the inner visor against the inside wall of the outer visor.

2. Anti-condensation visor according to claim 1, in which the mechanical retaining means is a pin-shaped element, around which a plastic bush is fitted.

3. Anti-condensation visor according to claim 2, in which the pin-shaped element is a blind rivet.

4. Anti-condensation visor according to claim 1, in which at least one recess is provided in the inner visor.

5. Anti-condensation visor according to claim 4, in which two recesses are provided in the inner visor, at opposite sides of the inner visor and in which two retaining means are fitted in the outer visor at a distance from each other which is no greater than the distance between the recesses.

6. Anti-condensation visor according to claim 1, in which at least one lip for handling the inner visor is provided on the inner visor.

7. Anti-condensation visor according to claim 1, in which the inner visor is made of a plastic.

8. Anti-condensation visor according to claim 7, in which the plastic is cellulose acetate.

9. Anti-condensation visor according to claim 1, in which a coloring agent is applied to essentially at least one of the surfaces of the inner visor.

10. Anti-condensation visor according to claim 1, in which a color agent is placed in the material from which the inner visor is made.

11. Anti-condensation visor according to claim 1, in which said inner visor comprises at least one recess and at least one lip for handling the visor is provided on the visor.

12. Set for producing an anti-condensation visor by detachably fitting an inner visor to an outer visor through mechanical retaining means, said outer visor being situated on the outermost peripheral surface of a helmet to which said visor belongs, said outer visor being provided with openings for fitting on said helmet and having a lip for a user to fold away, said set comprising an inner visor of hydrophilic material adapted to rest over essentially its entire surface against the inside wall of said outer visor, as well as said retaining means, and said inner visor having a radius of curvature which is greater than the radius of curvature of the outer visor, in order to obtain an initial tension for the purpose of pressing the inner visor against the inside wall of the outer visor.

13. Set according to claim 12, comprising at least one plastic bush.

* * * * *